US005865029A

United States Patent [19]

Brieschke

[11] Patent Number: 5,865,029

[45] **Date of Patent: *Feb. 2, 1999**

[54] AIR/OIL INTENSIFIER HAVING MULTIPLE SENSORS

[75] Inventor: Todd M. Brieschke, Temperance, Mich.

[73] Assignee: Aries Engineering Company, Inc., Toledo, Ohio

[ * ] Notice: The term of this patent shall not extend beyond the expiration date of Pat. No. 5,582,009.

[21] Appl. No.: 891,576

[22] Filed: Jul. 11, 1997

[51] Int. Cl.[6] ..... F15B 7/00

[52] U.S. Cl. ..... 60/560; 60/563; 92/151; 91/4 R

[58] Field of Search ..... 91/4 R; 92/5 R, 92/150, 151; 60/534, 560, 567, 563

[56] References Cited

U.S. PATENT DOCUMENTS

| | | | |
|---|---|---|---|
| 3,059,433 | 10/1962 | Hirsch . | |
| 3,293,997 | 12/1966 | Napolitano . | |
| 3,426,530 | 2/1969 | Georgelin . | |
| 4,961,317 | 10/1990 | Wolfbauer, III | 91/4 R |
| 5,265,423 | 11/1993 | Glaser | 92/151 XZ |
| 5,361,680 | 11/1994 | Matsui | 92/151 X |
| 5,377,488 | 1/1995 | Malina | 60/560 |
| 5,394,693 | 3/1995 | Plyter | 94/4 R |
| 5,582,009 | 12/1996 | Brieschke . | |

*Primary Examiner*—Hoang Nguyen
*Attorney, Agent, or Firm*—MacMillan, Sobanski & Todd, LLC

[57] ABSTRACT

An intensifier type of fluid actuator includes multiple sensors for sensing various operational characteristics of the intensifier. The intensifier includes a first manifold connected by a first tube to a second manifold to define an intensifier chamber, a third manifold connected by a second tube to the second manifold to define a reservoir chamber, and a fourth manifold connected by a third tube to the third manifold to define a work chamber. An intensifier piston is disposed within the intensifier chamber and has an intensifier rod secured thereto that extends through the second manifold into the reservoir chamber and through the third manifold into the work chamber. A reservoir piston is disposed within the reservoir chamber and includes an opening formed therethrough, through which the intensifier rod extends. The second body includes a fifth manifold connected by a fourth tube to a sixth manifold to define a piston chamber. A work piston is disposed within the piston chamber and has a work rod secured thereto that extends through the sixth manifold from the second body. A plurality of ports are provided for selectively providing pressurized fluid in the intensifier chamber, the reservoir chamber, the first work chamber, and the piston chamber to selectively extend the work rod into engagement with the workpiece. A position sensor can be mounted on the fourth manifold of the second body for sensing the axial position of the work piston relative to the second body. A pressure sensor can communicate with the intensifier chamber for sensing the magnitude of the pressure therein, which is representative of the pressure generated by the intensifier. A flow rate sensor can be disposed between the work chamber and the piston chamber for sensing the rate of fluid flowing therebetween, which is representative of the velocity of movement of the work piston relative to the body.

15 Claims, 3 Drawing Sheets

AIR/OIL INTENSIFIER HAVING MULTIPLE SENSORS

BACKGROUND OF THE INVENTION

This invention relates in general to fluid actuators for causing movement of a piston relative to a cylinder. In particular, this invention relates to an air/oil intensifier type of fluid actuator having multiple sensors for measuring various operational characteristics of the intensifier cylinder.

Fluid actuators are well known devices which are adapted to generate mechanical movement in response to the application of pressurized fluid, such as air or oil. A basic fluid actuator includes a hollow cylinder having a piston sidably disposed therein. The outer circumferential surface of the piston slidably and sealingly engages the inner circumferential surface of the cylinder so as to divide the interior of the cylinder into first and second chambers. When a pressurized fluid is supplied to the first chamber and the second chamber is vented, a pressure differential is created across the piston. This pressure differential causes the piston to slide relative to the cylinder in a first direction. Similarly, when a pressurized fluid is supplied to the second chamber and the first chamber is vented, the pressure differential created across the piston causes it to slide relative to the cylinder in a second direction. One or more fluid valves are usually provided to control the supply of pressurized fluid to and the venting of the two chambers of the cylinder so as to effect movement of the piston in a desired manner.

Typically, a rod is connected to the piston for movement therewith. The rod extends outwardly from the cylinder into engagement with a workpiece. Thus, when the piston is moved within the cylinder as described above, the workpiece is moved therewith. The magnitude of the force which is generated against the workpiece is equal to the product of the pressure of the fluid in the chamber and the surface area of the piston exposed to that pressurized fluid. Thus, for example, if the magnitude of the pressurized fluid is one hundred pounds per square inch (p.s.i.) and the surface area of the piston is two square inches, then the magnitude of the force exerted by the piston against the workpiece will be two hundred pounds. Fluid actuators of this general type are commonly used in a variety of applications.

In some applications, however, the magnitude of the pressurized fluid available for use by the fluid actuator is limited. For example, in a typical manufacturing facility, pressurized air may be generated by a central supply system at a standard pressure, such as one hundred p.s.i., for the entire facility. At the same time, the magnitude of the force necessary for the fluid actuator to perform a given task may be relatively large, such as one thousand pounds. If a basic fluid actuator structure as described above were to be used to perform this task, the piston would have to very large (ten square inches in this example) in order to generate the necessary force. Obviously, it is undesirable from several standpoints to provide such a physically large piston.

To address the problem of generating relatively large forces using limited fluid pressures and relatively small pistons, it is known to modify the basic fluid actuator structure to generate an increased amount of force. These modified fluid actuator structures, which are commonly referred to as intensifiers, use multiple interacting pistons to multiply the forces produced by the pressurized fluid against the pistons, while maintaining relatively small sizes for the pistons. A typical intensifier structure includes a cylinder which is divided by an internal manifold into two working areas. In the first working area, a first piston is provided which divides the interior thereof into first and second chambers. A rod extends from the first piston through the manifold into the second working area. In the second working area, a second piston is provided which divides the interior thereof into first and second chambers.

When pressurized fluid is supplied to the first chamber of the first working area, a first force is generated against the first piston as described above. Movement of the first piston causes corresponding movement of the first rod in the first chamber of the second working area. The first chamber of the second working area is typically filled with a relatively incompressible liquid, such as oil. Thus, a second force is generated against the second piston because of the movement of the rod. The rod has a much smaller surface area than the first piston. Thus, the magnitude of the pressure generated in the first chamber of the second area against the second piston is multiplied relative to the original pressure exerted against the first piston. This multiplied pressure is applied against the surface area of the second piston and generates a multiplied force. A second rod connected to the second piston transmits the multiplied force to a workpiece.

Air/oil intensifiers are commonly used in manufacturing processes for performing systematic functions in a repeatable manner. For example, an intensifier can be adapted to operate a punch tool to perform a cut-out operation on a succession of workpieces traveling along a conveyor system. Ideally, the air/oil intensifier would perform the exact operation and obtain exactly the same result for every workpiece. However, for various reasons, such as misalignment of the workpiece, differences between the sizing of the workpieces, or malfunction of the air/oil intensifier, variations may occur in the manufacturing process. To insure that the workpieces are being manufactured within design tolerances, it is desirable to monitor the operation of the air/oil intensifier. One well known method for monitoring the operation of a manufacturing process involves the use of statistical process control. Statistical process control is the systematic measuring of tolerances or other criteria for one or more stages in the manufacturing process. These measurements are then plotted statistically so that trends in the manufacturing can be ascertained. By using statistical process control methods, variations in the manufacturing process which can result in the manufacture of defective workpieces can be determined in advance and corrected before such defective workpieces are actually manufactured.

In the past, the application of statistical process control methods to the manufacture of workpieces with an air/oil intensifier has involved the systematic inspection of the workpiece after the manufacturing operation has been performed by the air/oil intensifier. However, it is relatively time consuming and expensive to physically inspect the workpieces in this manner. Additionally, while a physical inspection of the workpiece may reveal the presence of a defect or a trend toward manufacturing a defect, the cause of such defect may not be readily ascertainable. This is particularly true when the cause of the manufacturing defect lies in the operation of the air/oil intensifier. Thus, it would be desirable to provide an improved structure for an air/oil intensifier which facilitates the application of statistical process control methods to the operation thereof.

SUMMARY OF THE INVENTION

This invention relates to an intensifier type of fluid actuator having multiple sensors for sensing various operational characteristics of the intensifier. The intensifier includes first and second bodies which can be separate components or incorporated into a single structure. The first body includes a first manifold connected by a first tube to a second manifold to define an intensifier chamber, a third manifold connected by a second tube to the second manifold to define a reservoir chamber, and a fourth manifold connected by a third tube to the third manifold to define a work chamber. An intensifier piston is disposed within the intensifier chamber and has an outer surface in sealing and sliding engagement with the first tube. The intensifier rod is secured to the intensifier piston and extends through the second manifold into the reservoir chamber. The intensifier rod is movable through the third manifold into the work chamber. A reservoir piston is disposed within the reservoir chamber and has an outer surface in sealing and sliding engagement with the second tube. The reservoir piston includes an opening formed therethrough. The intensifier rod extends through the opening formed in the reservoir piston. The second body includes a fifth manifold connected by a fourth tube to a sixth manifold to define a piston chamber. A work piston is disposed within the piston chamber and has an outer surface in sealing and sliding engagement with the fourth tube. A work rod is secured to the work piston and extends through the sixth manifold from the second body. A plurality of ports are provided for selectively providing pressurized fluid in the intensifier chamber, the reservoir chamber, the first work chamber, and the piston chamber to selectively extend the work rod into engagement with the workpiece. A position sensor can be mounted on the fourth manifold of the second body for sensing the axial position of the work piston relative to the second body. A pressure sensor can communicate with the intensifier chamber for sensing the magnitude of the pressure therein, which is representative of the pressure generated by the intensifier. A flow rate sensor can be disposed between the work chamber and the piston chamber for sensing the rate of fluid flowing therebetween, which is representative of the velocity of movement of the work piston relative to the body.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
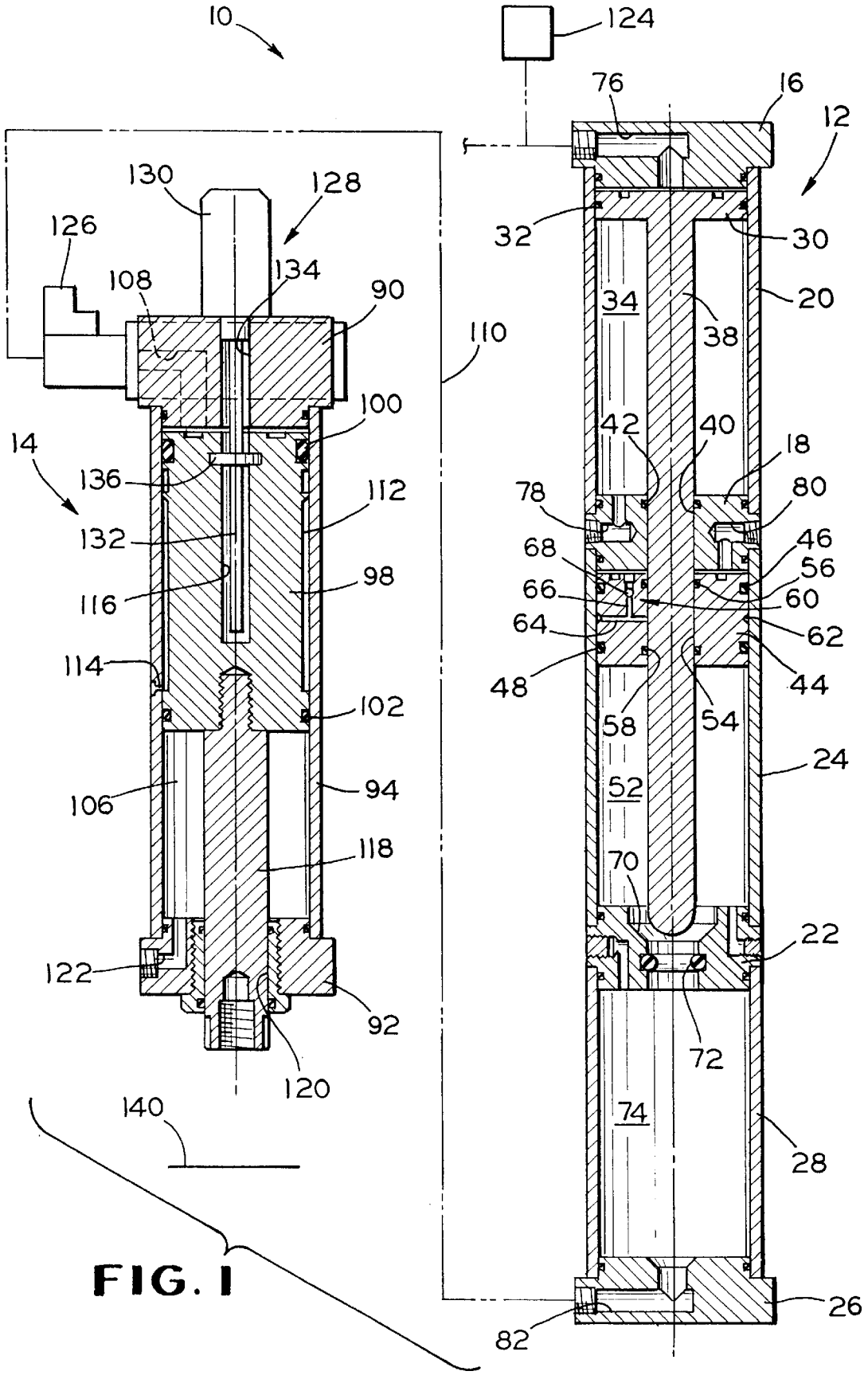
FIG. 1 is sectional elevational view of an intensifier cylinder in accordance with this invention shown in a first operating position.
Figure 2:
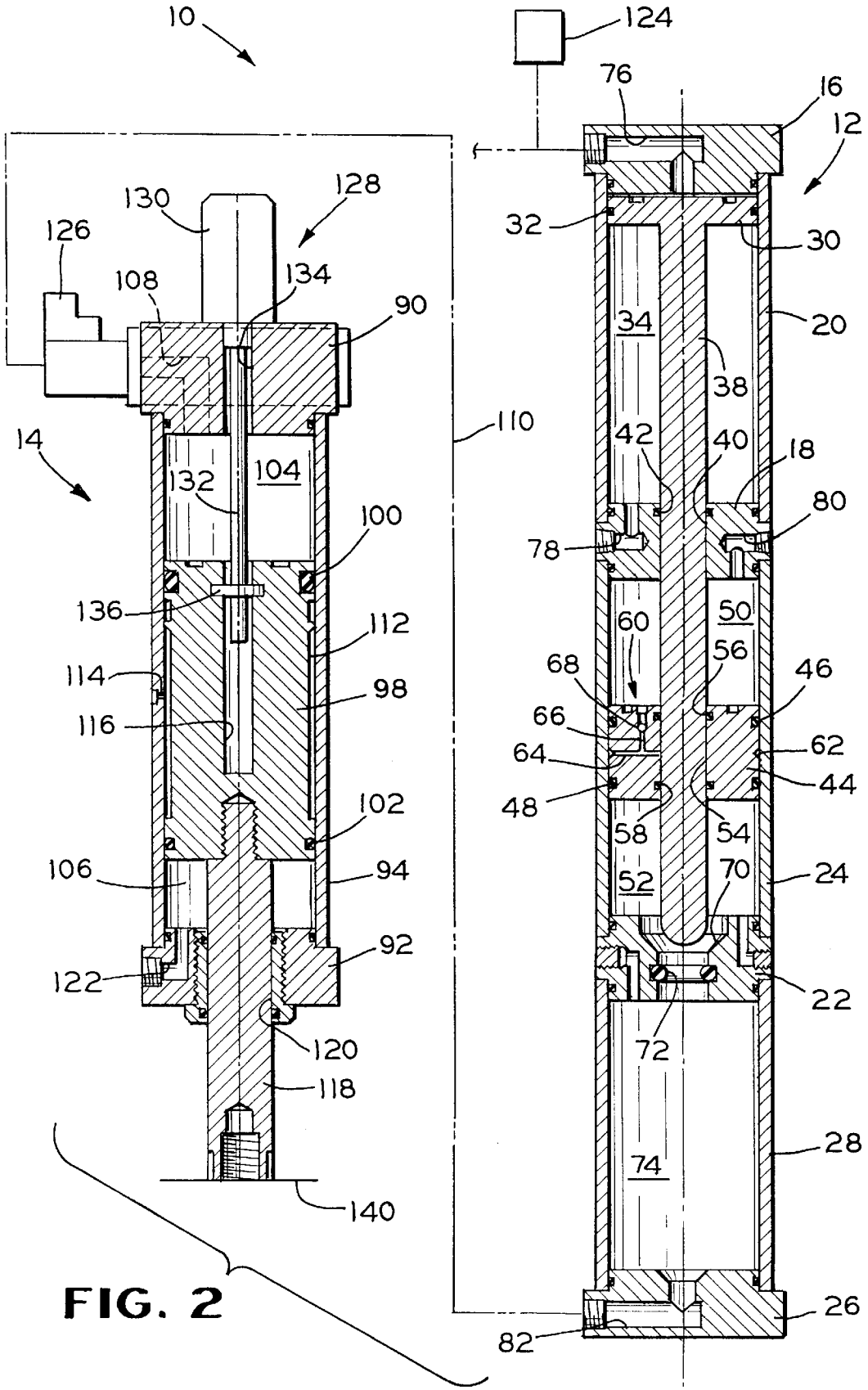
FIG. 2 is sectional elevational view of the intensifier cylinder illustrated in FIG. 1 shown in a second operating position.
Figure 3:
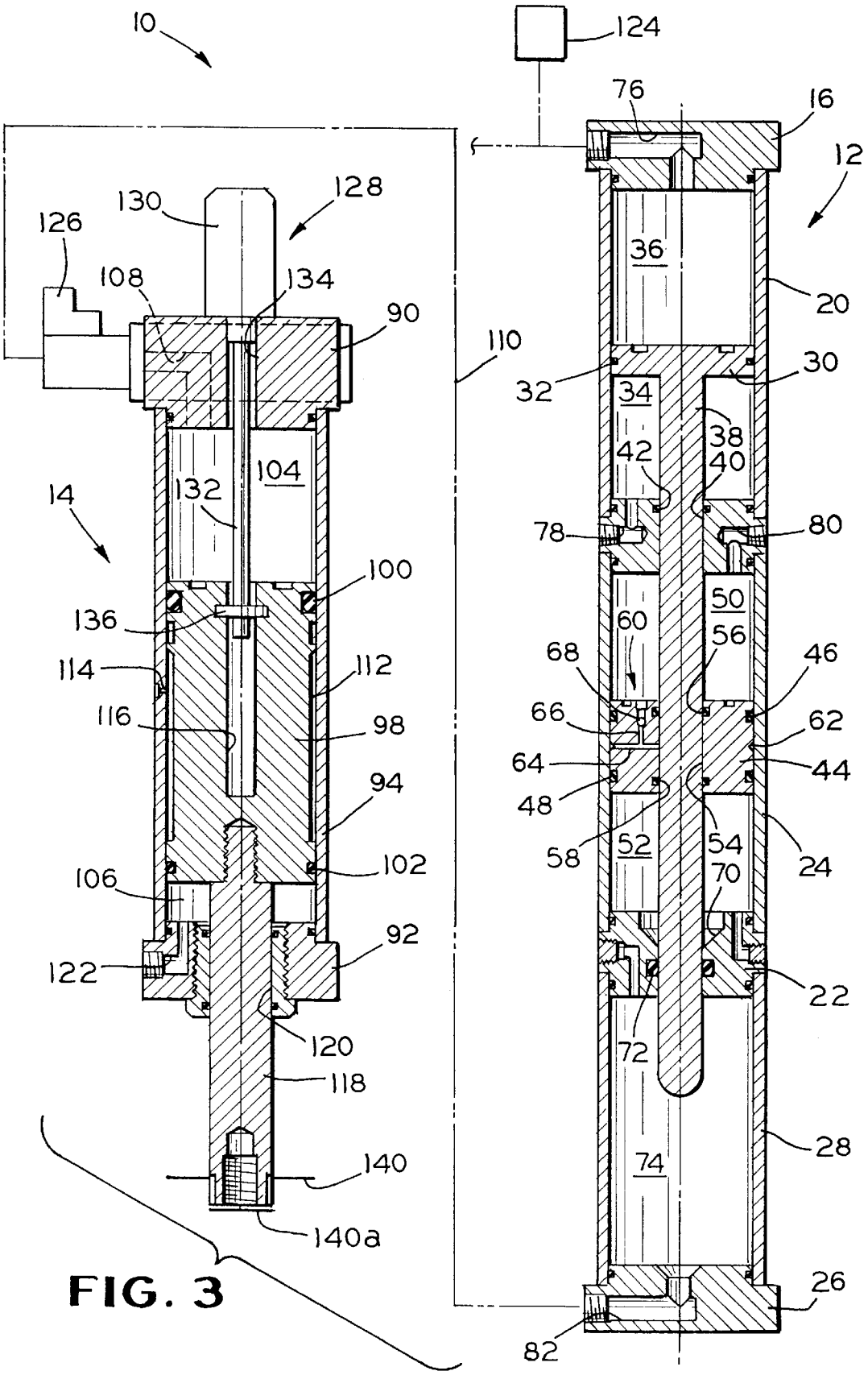
FIG. 3 is sectional elevational view of the intensifier cylinder illustrated in FIGS. 1 and 2 shown in a third operating position.

Referring now to the drawings, there is illustrated in FIG. 1 an air/oil intensifier, indicated generally at 10, in accordance with this invention. The intensifier 10 includes first and second stationary cylindrical bodies 12 and 14 which provide rigid support during operation. The first and second stationary cylindrical bodies 12 and 14 can be separate components, such as shown in FIGS. 1 through 3, or can be incorporated together into a single body. Preferably, the first and second stationary cylindrical bodies 12 and 14 are separate components, the reason for which will be explained in detail below.

The first body 12 of the intensifier 10 includes a first manifold 16 and a second manifold 18 which are connected together by a first hollow cylindrical tube 20. As will be discussed in greater detail below, the first manifold 16, the second manifold 18, and the first tube 20 cooperate to define an intensifier chamber for the intensifier 10. The first body 12 of the intensifier 10 further includes a third manifold 22 which is connected to the second manifold 18 by a second hollow cylindrical tube 24. As will be discussed in greater detail below, the second manifold 18, the third manifold 22, and the second tube 24 cooperate to define a reservoir chamber for the intensifier 10. The first body 12 of the intensifier 10 further includes a fourth manifold 26 which is connected to the third manifold 22 by a third hollow cylindrical tube 28. As will be discussed in greater detail below, the third manifold 22, the fourth manifold 26, and the third tube 28 cooperate to define a work chamber for the intensifier 10.

An intensifier piston 30 is disposed within the intensifier chamber for sliding movement relative thereto. The intensifier piston 30 is generally cylindrical in shape, having an annular groove formed in the outer circumferential surface thereof. A seal 32 is disposed within the groove for sealingly engaging the inner circumferential surface of the first tube 20. Thus, the intensifier piston 30 divides the intensifier chamber into an intensifier retract chamber 34 and an intensifier advance chamber 36 (see FIG. 3). The intensifier retract chamber 34 is defined between the intensifier piston 30, the first tube 20, and the second manifold 18. The intensifier advance chamber 36 is defined between the first manifold 16, the first tube 20, and the intensifier piston 30. An intensifier piston rod 38 is connected to the intensifier piston 30 for movement therewith. The intensifier piston rod 38 extends substantially parallel to the longitudinal axis of the first body 12 of the intensifier 10, through a co-axial opening 40 formed through the second manifold 18, and into the reservoir chamber. A seal 42 provided within a groove formed in the opening 40 of the second manifold 18 prevents fluid communication between the intensifier chamber and the reservoir chamber.

A reservoir piston 44 is disposed within the reservoir chamber for sliding movement relative to the first body 12 of the intensifier 10. First and second seals 46 and 48 are disposed in respective annular grooves formed in the outer circumferential surfaces of the opposed ends of the reservoir piston 44. The seals 46 and 48 sealingly engaging the inner circumferential surface of the second tube 24. Thus, the reservoir piston 44 divides the reservoir chamber into a reservoir air chamber 50 (see FIGS. 2 and 3) and a reservoir oil chamber 52. The reservoir air chamber 50 is defined between the second manifold 18, the second tube 24, and the reservoir piston 44. The reservoir oil chamber 52 is defined between the reservoir piston 44, the second tube 24, and the third manifold 22. The reservoir oil chamber 52 is filled with oil or a similar relatively incompressible liquid. The reservoir piston 44 is generally cylindrical in shape, having a co-axial bore 54 formed therethrough. The intensifier piston rod 38 extends completely through this co-axial bore 54. Seals 56 and 58 are disposed within respective grooves formed in the bore 54 for sealingly engaging the outer circumferential surface of the intensifier piston rod 38.

A check valve assembly, indicated generally at 60, is provided within the reservoir piston 44. The check valve assembly 60 includes an annular groove 62 formed in the outer circumferential surface of the reservoir piston 44. A radial bore 64 is formed through the reservoir piston 44, extending from the annular groove 62 to a portion of the co-axial bore 54 located between the seals 56 and 58. Thus, the annular groove 62 communicates with an inner annular space defined between the seals 56 and 58 of the reservoir piston 44 and the intensifier piston rod 38. An axial bore 66 extends through the reservoir piston 44 from the radial bore 64 to the end of the reservoir piston 44 adjacent to the second manifold 18. A check valve 68, such as a spring loaded ball-type check valve, is located within the axial bore 66. The check valve 68 permits the one-way flow of fluid through the check valve assembly 60 from the radial bore 64 to the reservoir air chamber 50. The structure and operation of the check valve assembly 60 are discussed in detail in U.S. Pat. No. 5,582,009, the disclosure of which is incorporated herein by reference.

A chamfered bore 70 is formed co-axially through the third manifold 22 for slidably receiving the intensifier piston rod 38. A seal 72 is disposed within a portion of the bore 70 for selectively sealingly engaging the outer circumferential surface of the intensifier piston rod 38. The purpose for this sealing engagement will be explained below. As mentioned above, the work chamber 74 is defined between the third manifold 22, the third tube 28, and the fourth manifold 26. The work chamber 74 communicates with the reservoir oil chamber 52 through the chamfered bore 70 and, thus, is also filled with oil.

The first body 12 of the intensifier 10 includes a number of ports for effecting the operation thereof. A first port 76 is formed through the first manifold 16 and communicates with the intensifier advance chamber 36. A second port 78 is formed through the second manifold 18 and communicates with the intensifier retract chamber 34. A third port 80 is also formed through the second manifold 12 and communicates with the reservoir air chamber 33. A fourth port 82 is formed through the fourth manifold 26 and communicates with the reservoir air chamber 50. As is well known in the art, the ports 76, 78, and 80 communicate through conventional valves (not shown) with either a source of pressurized fluid (typically pressurized air) or with the atmosphere to effect the operation of the intensifier 10. As will be described in detail below, the fourth port 82 communicates with a portion of the second body 14 of the intensifier.

The second body 14 of the intensifier 10 includes a fifth manifold 90 and a sixth manifold 92 which are connected together by a fourth hollow cylindrical tube 94. The fifth manifold 90, the sixth manifold 92, and the fourth tube 94 cooperate to define a piston chamber. A work piston 98 is disposed within the piston chamber for sliding movement relative to the second body 14. The work piston 98 is generally cylindrical in shape. First and second seals 100 and 102 are disposed in respective annular grooves formed in the outer circumferential surface of the opposed ends of the work piston 98. The seals 100 and 102 sealingly engage the inner circumferential surface of the fourth tube 94. Thus, the work piston 98 divides the piston chamber into a piston oil chamber 104 (see FIGS. 2 and 3) and a piston air chamber 106. The piston oil chamber 104 is defined between the work piston 98, the fourth tube 94, and the fifth manifold 90. The piston air chamber 106 is defined between the work piston 98, the fourth tube 94, and the sixth manifold 92. The piston oil chamber 104 is in fluid communication with the work chamber 74 by means of a fluid conduit (indicated in phantom lines at 110) extending between the fourth port 82 of the fourth manifold 26 and a fifth port 108 formed through the fifth manifold 90.

The work piston 98 has an annular recess 112 formed in the central portion of the outer circumferential surface thereof. The recess 112 defines an outer annular space between the work piston 98 and the fourth tube 94. A vent bore 114 is formed through the wall of the fourth tube 94. As shown in FIGS. 1, 2, and 3, the work piston 98 is positioned such that the vent bore 114 extends through and communicates with the outer annular space defined on the work piston 98 to vent it to the atmosphere. The annular recess 112 and the vent bore 114 are provided because it is desirable to have the air gap defined by the recess 112 between the seals 100 and 102 vented to atmosphere during the stroke of the work piston 98. Thus, the axial length of the recess 112 is preferably sized to match the maximum stroke length of the work piston 98. A co-axial counterbore 116 is formed in the end of the work piston 98 adjacent the fifth manifold 90, the reason for which will be explained below. A work piston rod 118 is connected to the work piston 98 for movement therewith. The work piston rod 118 extends substantially parallel to the longitudinal axis of the second body 14 through a co-axial opening 120 formed through the sixth manifold 92 out of the second body 14. Any one of a number of conventional tools may be connected to the end of the work piston rod 118, as is well known in the art. A sixth port 122 is formed through the sixth manifold 92 and communicates with the piston air chamber 106. The sixth port 122 communicates through conventional valves (not shown) with either a source of pressurized fluid (typically pressurized air) or with the atmosphere to effect the operation of the intensifier 10.

The intensifier 10 includes several sensors for generating electrical signals which are representative of various operational characteristics of the intensifier 10. An air pressure sensor, represented schematically at 124, communicates with the first port 76 of the first body 12 of the intensifier 10. The air pressure sensor 124 measures the pressure of the air supplied within the intensifier advance chamber 36 from the source of pressurized fluid, as discussed above. The intensifier 10 further includes a flow rate sensor 126 mounted on the fifth manifold 90 of the second body 14. The flow rate sensor 126 is provided in the fluid conduit 110 between the fourth port 82 of the first body 12 and the fifth port 108 of the second body 14. The flow rate sensor 126 measures the rate of the hydraulic fluid flowing between the work chamber 74 and the piston oil chamber 104.

The intensifier 10 further includes a position sensor, indicated generally at 128, for measuring the position of the work piston 98 relative to the second body 14 of the intensifier 10. Although any conventional position sensor may be used, the position sensor 128 is preferably a linear variable resistance displacement transducer including a body 130 mounted on the fifth manifold 90 of the second body 14. An elongated mandrel 132 extends outwardly from the body 130. The mandrel 132 extends through a bore 134 formed through the fifth manifold 90 and into the counterbore 116 formed in the work piston 98. The mandrel 132 is fixed in position relative to the body 130 and the fifth manifold 90. A conventional electrical resistance element (not shown) is secured to the mandrel 132. A wiper 136 is secured to the work piston 98 for axial movement therewith. The wiper 136 is mounted for a sliding electrical engagement across the resistance element secured to the mandrel 132. By means well known in the art, the displacement transducer 128 can sense the position of the wiper 136 with respect to the mandrel 132. Because the wiper 136 reciprocates axially with the work piston 98, the axial position of the work piston 98 with respect to the second body 14 can be determined by the position sensor 128.

The operation of the intensifier 10 will now be described. The intensifier 10 is initially disposed in the retracted position illustrated in FIG. 1. In this position, the intensifier piston 30 is disposed adjacent to the first manifold 16, the reservoir piston 44 is disposed adjacent to the second manifold 18, and the work piston 98 is disposed adjacent to the fifth manifold 90. As a result, the work piston rod 118 is, for the most part, retracted within the piston air chamber 106. To begin an advance stroke, pressurized air is supplied through the second port 78 to the intensifier retract chamber 34 and through the third port 80 to the reservoir air chamber 50. As a result, the intensifier piston 30 is urged upwardly to maintain its position adjacent to the first manifold 16, while the reservoir piston 44 is urged downwardly toward the third manifold 22, as shown in FIG. 2. As the reservoir piston 44 advances downwardly, oil in the reservoir oil chamber 52 is displaced through the opening 70 into the work chamber 74. Simultaneously, the oil in the work chamber 74 is displaced through the fourth port 82, the fluid conduit 110, and the fifth port 108 into the piston oil chamber 104. As a result, the work piston 98 and the work piston rod 118 are advanced downwardly until the leading end of the work piston rod 118 engages a workpiece 140. Inasmuch as there is virtually no resistance to this initial downward movement until the work piston rod 118 engages the workpiece 140, the advance stroke of the work piston rod 118 occurs relatively rapidly. FIG. 2 illustrates the positions of the various components of the intensifier 10 after the completion of the advance stroke.

After the advance stroke is completed, a work stroke is initiated. To begin the work stroke, pressurized air is continued to be supplied through the third port 80 to reservoir air chamber 50. However, pressurized air is then supplied through the first port 76 to the intensifier advance chamber 36, while the intensifier retract chamber 34 is vented to the atmosphere through the second port 78. The pressurized air in the intensifier advance chamber 36 reacts against the intensifier piston 30 to generate a first force. As a result, the intensifier piston 30 is advanced downwardly toward the second manifold 18. As the intensifier piston 30 advances, the intensifier piston rod 38 moves into through the opening 70 and into engagement with the seal 72. When this occurs, the work chamber 74 and the piston oil chamber 104 are sealed, and the volume of oil contained therein is fixed. Further advancement of the intensifier piston rod 38 into the work chamber 74 causes a second pressure to be exerted by the oil against the work piston 98. The pressurized oil in the piston oil chamber 104 reacts against the work piston 98 to generate a second force. This second force is greater than the first force because the net area of the intensifier piston rod 38 is smaller than the net area of the work piston 98. As a result, the work piston 98 is advanced downwardly toward the fifth manifold 92, and the work rod 118 is moved with a relatively large force toward the workpiece 140. For example, if a conventional punch tool is secured to the lower end of the work piston rod 118, a cut-out 140*a* can be formed as shown in FIG. 3 at the completion of the work stroke. FIG. 3 illustrates the positions of the various components of the intensifier 10 after the completion of the work stroke.

Thus, it can be seen that during the work stroke of the intensifier 10, the magnitude of the force exerted by the work piston rod 118 against the workpiece 140 is proportional to the magnitude of the air pressure within the intensifier advance chamber 36. This is because the magnitude of the first force F1 generated by the intensifier piston 30 is equal to the product of the magnitude of the pressurized air P1 in the intensifier advance chamber 36 and the net area A1 of the intensifier piston 30. Similarly, the magnitude of the second force F2 generated by the work piston 98 and the attached work piston rod 118 is equal to the product of the magnitude of the pressurized oil P2 in the piston oil chamber 104 and the net area A2 of the work piston 98. However, the magnitude of the pressurized oil P2 in the piston oil chamber 104 is equal to the magnitude of the first force F1 exerted by the intensifier piston 30 through the intensifier piston rod 38 divided by the net area A3 of the end of the intensifier piston rod 38 presented within the work chamber 74. Consequently, the magnitude of the second force F2 generated by the work piston 98 is equal to the product of the magnitude of the first force F1 and the net area A2 of the work piston 98, divided by the net area A3 of the end of the intensifier piston rod 38 presented within the work chamber 74. Substituting the initial calculation for the magnitude of the first force F1, it can be seen that the magnitude of the second force F2 generated by the work piston 98 is equal to the product of (1) the magnitude of the pressurized air P1 in the intensifier advance chamber 36, (2) the net area A1 of the intensifier piston 30, and (3) the net area A2 of the work piston 98, all of which divided by the net area A3 of the end of the intensifier piston rod 28 presented within the work chamber 74. These calculations mathematically illustrate the force intensifying action of the intensifier 10.

To retract the work piston rod 118 within the piston air chamber 106 after completion of the work stroke, the intensifier advance chamber 36 is vented to the atmosphere through the first port 76. At the same time, pressurized air is supplied through the second port 78 to the intensifier retract chamber 34, urging the intensifier piston 30 upwardly toward the first manifold 16. If desired, a second work stroke can be performed by re-pressurizing the intensifier advance chamber 36 to further advance the work piston rod 118 downwardly. However, to retract the work piston rod 118, the reservoir air chamber 50 is vented to the atmosphere through the third port 80, while pressurized air is supplied to the piston air chamber 106 through the fifth port 122. As the work piston 98 moves upwardly, the oil in the work chamber 74 and the piston oil chamber 104 is displaced back into the reservoir oil chamber 52.

As discussed above, the air pressure sensor 124, the flow rate sensor 126, and the displacement transducer 128 monitor certain operational characteristics of the intensifier 10 and generate electrical signals which are representative thereof. The signals from the sensors 124, 126, and 128 can be displayed in a conventional manner to permit the operating characteristics of the intensifier 10 to be monitored. If desired, the signals from the sensors 124, 126, and 128 can be fed to an electronic controller (not shown) for automatic statistical processing.

In the illustrated embodiment, the air pressure sensor 124 measures the pressure of the air within the intensifier advance chamber 36. For the reasons set forth above, this measurement will yield a signal which is representative of the magnitude of the force exerted by the work piston rod 118 against the workpiece 140 during the work stroke of the intensifier 10. The air pressure sensor 124 can be embodied as any suitable sensor capable of measuring fluid pressure. The air pressure sensor 124 may, if desired, be located within the intensifier 10. Alternatively, the air pressure sensor 124 may be embodied as a liquid pressure sensor for sensing the pressure of the oil within one of the oil chambers within the intensifier 10.

In the illustrated embodiment, the flow rate sensor 126 measures the flow rate of the hydraulic fluid flowing between the work chamber 74 and the piston oil chamber 104. Because oil is a relatively incompressible fluid, the rate of the hydraulic fluid flowing between the work chamber 74 and the piston oil chamber 104 is directly proportional to the velocity of the work piston 98 and the work piston rod 118 as they are moved during the approach and work strokes. Thus, the flow rate sensor 126 can be used to generate an electrical signal which is representative of the velocity of the work piston rod 118. The flow rate sensor 126 can be embodied any suitable sensor capable of measuring fluid flow and may be located elsewhere in the intensifier 10 than as specifically shown in the drawings.

In the illustrated embodiment, the displacement transducer 128 measures the axial displacement of the wiper 136 relative to the mandrel 132, as described above. Because the wiper 136 is secured for axial movement with the work piston 98 and the mandrel 132 is fixed in position relative to the second body 14, the displacement transducer 128 can be used to generate an electrical signal which is representative of the actual position of the work piston 98 relative to the second body 14. As mentioned above, the displacement transducer 128 can be embodied as any suitable sensor capable of measuring the position of the work piston 98 relative to the second body 14. The displacement transducer 128 may also be located elsewhere in the intensifier than as specifically shown in the drawings.

Although the intensifier 10 is shown in FIGS. 1 through 3 having a first body 12 separate from a second body 14, the first and second bodies 12 and 14 can be incorporated into a single body. In such a case, the work chamber 74 and the piston oil chamber 104 would form a single chamber defined between the work piston 98, the third mandrel 22, and a tube (not shown) connecting the third mandrel 22 to the fifth mandrel 92. Preferably, the first body 12 is separate from the second body 14 due to the co-axial positioning of the displacement transducer 128 at one end of the second body 14. By having two separate first and second bodies 12 and 14, the displacement transducer 128 can easily be mounted on and incorporated in the intensifier 10. Similarly, the flow rate sensor 126 can be easily incorporated into the intensifier for measuring the flow from the work chamber 74 to the piston oil chamber 106.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. An air/oil intensifier comprising:

a body including first, second, third, and fourth manifolds, said first and second manifolds defining an intensifier chamber, said second and third manifolds defining a reservoir chamber, and said third and fourth manifolds defining a work chamber;

an intensifier piston disposed within said intensifier chamber and having an intensifier rod secured thereto that extends through said second manifold into said reservoir chamber and is movable through said third manifold into said work chamber;

a reservoir piston disposed within said reservoir chamber and having a central opening formed therethrough through which said intensifier rod extends;

a work piston disposed within said work chamber and having a work rod secured thereto that extends through said fourth manifold from said body;

a plurality of ports formed in said body for permitting pressurized fluid to be selectively supplied to said intensifier chamber, said reservoir chamber, and said work chamber to selectively move said work rod relative to said body; and a sensor for generating a signal which is representative of an operating characteristic of said air/oil intensifier.

2. The air/oil intensifier defined in claim 1 wherein said operating characteristic is the pressure supplied within said intensifier chamber.

3. The air/oil intensifier defined in claim 2 wherein said sensor is an air pressure sensor for generating a signal which is representative of the magnitude of the air pressure supplied within said intensifier chamber.

4. The air/oil intensifier defined in claim 1 wherein said operating characteristic is the velocity of movement of said work piston relative to said body.

5. The air/oil intensifier defined in claim 4 wherein said sensor is a flow rate sensor for generating a signal which is representative of the rate of fluid flow into said work chamber.

6. The air/oil intensifier defined in claim 1 wherein said operating characteristic is the position of said work piston relative to said body.

7. The air/oil intensifier defined in claim 6 wherein said sensor is a linear displacement sensor for generating a signal which is representative of the movement of said piston relative to said body.

8. The air/oil intensifier defined in claim 1 wherein said operating characteristic is the pressure supplied within said intensifier chamber and the velocity of movement of said work piston relative to said body.

9. The air/oil intensifier defined in claim 1 wherein said operating characteristic is the pressure supplied within said intensifier chamber and the position of said work piston relative to said body.

10. The air/oil intensifier defined in claim 1 wherein said operating characteristic is the velocity of movement of said work piston relative to said body and the position of said work piston relative to said body.

11. The air/oil intensifier defined in claim 1 wherein said operating characteristic is the pressure supplied within said intensifier chamber, the velocity of movement of said work piston relative to said body, and the position of said work piston relative to said body.

12. An air/oil intensifier comprising:

a first body including a first manifold connected by a first tube to a second manifold to define an intensifier chamber, a third manifold connected by a second tube to said second manifold to define a reservoir chamber, and a fourth manifold connected by a third tube to said third manifold to define a first work chamber;

a second body including a fifth manifold connected by a fourth tube to a sixth manifold to define a second work chamber being in fluid communication with said first work chamber;

an intensifier piston disposed within said intensifier chamber and having an outer surface in sealing and sliding engagement with said first tube, an intensifier rod being secured to said intensifier piston and extending through said second manifold into said reservoir chamber, said intensifier rod being movable through said third manifold into said first work chamber;

a reservoir piston disposed within said reservoir chamber and having an outer surface in sealing and sliding engagement with said second tube, said reservoir piston including a central opening formed therethrough, said intensifier rod extending through said opening in said reservoir piston;

a work piston disposed within said second work chamber and having an outer surface in sealing and sliding engagement with said fourth tube, a work rod being secured to said work piston, said work rod extending through said sixth manifold from said body;

means for selectively providing pressurized fluid in said intensifier chamber, said reservoir chamber, and said work chamber to selectively extend said work rod from said second body; and a sensor for sensing at least one of the position of said work piston relative to said second body, the pressure within said intensifier chamber, and the fluid flow rate of fluid flowing between said first work chamber and said second work chamber.

13. The air/oil intensifier defined in claim 12 wherein said sensor includes a first sensor for sensing the position of said work piston relative to said second body and a second sensor for sensing the fluid flow rate of fluid flowing between said first work chamber and said second work chamber.

14. The air/oil intensifier defined in claim 12 wherein said sensor includes a first sensor for sensing the position of said work piston relative to said second body, a second sensor for sensing the fluid flow rate of fluid flowing between said first work chamber and said second work chamber, and a third sensor for sensing the pressure within said intensifier chamber.

15. The air/oil intensifier defined in claim 12 wherein said sensor includes a linear variable resistance displacement transducer.

* * * * *